US009115545B2

(12) United States Patent
Biserna

(10) Patent No.: US 9,115,545 B2
(45) Date of Patent: Aug. 25, 2015

(54) EARTH DRILLING MACHINE

(75) Inventor: Ezio Biserna, Cesena (IT)

(73) Assignee: SOILMEC S.P.A., Cesena (FC) (IT)

( * ) Notice: Subject to any disclaimer, the term of this patent is extended or adjusted under 35 U.S.C. 154(b) by 613 days.

(21) Appl. No.: 13/388,220

(22) PCT Filed: Jul. 26, 2010

(86) PCT No.: PCT/IB2010/001821

§ 371 (c)(1),
(2), (4) Date: Apr. 12, 2012

(87) PCT Pub. No.: WO2011/012967

PCT Pub. Date: Feb. 3, 2011

(65) Prior Publication Data

US 2012/0186882 A1 Jul. 26, 2012

(30) Foreign Application Priority Data

Jul. 31, 2009 (IT) ..... TO2009A0593

(51) Int. Cl.
*E21B 15/00* (2006.01)
*E21B 17/07* (2006.01)
*E21B 7/02* (2006.01)

(52) U.S. Cl.
CPC ..... *E21B 17/07* (2013.01); *E21B 7/023* (2013.01)

(58) Field of Classification Search
USPC ..... 175/220, 215, 321, 19, 20
See application file for complete search history.

(56) References Cited

U.S. PATENT DOCUMENTS

| | | | | |
|---|---|---|---|---|
| 2,712,351 | A * | 7/1955 | Roth et al. | 431/4 |
| 3,491,555 | A * | 1/1970 | Arndt et al. | 464/162 |
| 4,137,974 | A * | 2/1979 | Decker | 173/147 |
| 5,186,266 | A | 2/1993 | Heller | |
| 2003/0037940 | A1 | 2/2003 | Howell | |
| 2006/0219440 | A1 * | 10/2006 | MacKay et al. | 175/61 |
| 2008/0217037 | A1 | 9/2008 | Howell | |

FOREIGN PATENT DOCUMENTS

| | | |
|---|---|---|
| DE | 198 31 755 | 12/1999 |
| EP | 1614853 | 11/2006 |
| IT | TO2004A000457 | 8/2005 |
| WO | WO 2009156056 A1 * | 12/2009 |

OTHER PUBLICATIONS

International Search Report for International Application No. PCT/IB2010/001821 dated Oct. 7, 2010.

* cited by examiner

*Primary Examiner* — David Andrews
*Assistant Examiner* — Taras P Bemko
(74) *Attorney, Agent, or Firm* — Merchant & Gould P.C.

(57) ABSTRACT

A machine for the drilling of the ground includes a guide tower (2) along which slides a group (3) for the handling of a battery of drilling rods (5) which moves along guides (21) of the tower. The group includes a sleeve (31) which gives rotation to a tube (4) to the lower part of which can be constrained at least a drilling rod (5) with a digging tool (6) or directly a digging tool (6).

10 Claims, 7 Drawing Sheets

EARTH DRILLING MACHINE

This application is a National Stage Application of PCT/IB2010/001821, filed 26 Jul. 2010, which claims benefit of Ser. No. TO 2009 A 000593, filed 31 Jul. 2009 in Italy and which applications are incorporated herein by reference. To the extent appropriate, a claim of priority is made to each of the above disclosed applications.

BACKGROUND

The present invention refers to machines for drilling of the ground.

In particular, the present invention relates to equipment used in machines for the mixing, consolidation and compaction of soil.

Various procedures are known for the consolidation of the ground through the formation of cylindrical columns of consolidated soil, based on the mixing of particles of the soil with legants, usually cemented mixtures.

The traditional procedure, through which a mainly mechanic mixing is carried out, uses the rotating movement of tools able to dig and disintegrate the soil through appendixes which radially extend to the axis of the tool. The soil so disintegrated is kneaded with a low-pressure (1-2 MPa) cemented mixture pumped through openings on the tubular shaft which supports the digging tool.

A known variant of the described procedure is to use higher pressures for the cemented mixtures. This technique, by using a combination of the mechanical action of the disintegrating members of the tool and of the kinetic energy of the pressurized jets, differs for a substantial execution speed, with considerable economic advantages.

FIG. 1 shows a typical machine M normally tracked for the drilling of the ground, which can bear the characteristics of the present invention.

This machine is provided with a vertical tower 2 or antenna along which slides a group 3 for the movement of drill rods commonly known as a "rotary table".

This motorized group moves along guides 21 of the tower and is hung on one or more traction and thrust handling devices (i.e.: hoists). Traction can be direct or multiplied (typically multiplied by two or four). The rotary table is hydraulic and transforms the energy provided by a pressurized fluid into mechanical energy. One or more hydraulic motors give rotary movement to one or more gears coupled to a crown. In the center of the crown is a flanged sleeve 31 provided with internal vertical listels 32, normally three or six, imparts rotation to a cylindrical rod, which also has external listels. The listels of the sleeve contact with the listels of the cylindrical rod making this last in the movement of rotation.

When the cylindrical rod is provided with external listels for transmitting movement or if it extends at least partially over the "rotary table", it is commonly called a tube 4.

In the bottom part of the tube is fixed the first of the rods of battery 5. Each rod is fixed to the following one with a joint having many shapes, screwed, flanged with screws or locked through pins.

The last rod bears in its lower part digging tool 6.

The tube is therefore a fundamental part of the machine because it receives the traction torque and the thrust of the rotary table and transmits the torque and thrust to the rods and conveys at the same time the pressurized fluid in direction of the digging tool.

The digging fluid is typically a consolidating fluid, generally a cement mixture, chemical mixture or concrete.

Trying to increase the depth of the excavation, it has been thought that the length of the tubes of traditional type should be increased.

In this light, it has been realized the possibility of stopping at various levels of the tube the rotary table, by inserting coupling and supporting points 41. In this way when the rotary is at the lower limit switch with respect to the guides of the tower, the tube can be inserted in the ground for several meters in such a way as to achieve treatment depths deeper than the length of the tower (typically up to 8-9 meters).

In order to face the extension of the tube, a rudder 7 is mounted which has the function of blocking the rotation of the fixed part of the cement grout feeding head 8 mounted on the top of the tube. In the absence of this accessory, the rubber pipes of the feeding of the treatment fluid would wind around the tube at every turn of the rod. The rudder is therefore an indispensable element, even if extremely not easy to handle and is also generally stressed by heavy oscillations when the rotation speed of the rotary acquires high values.

The technology and the available materials cautiously suggest not using too long tubes, having for example length higher than 8-9 meters, as this may affect the stability of the machine.

A kind of tube is described in patent application TO2004A000457 which refers to a continuous propeller ground drilling tool having an extension rod provided with at least two coaxial extensions, which moving between them, determine a fictitious extension of the drilling. They are connected at the bottom side to the propeller battery and have a propeller in the most external element.

This system actually permits a relative displacement between the two sliding elements but with an encumbrance in length equal to "x", permits an extension of the drilling equal to the encumbrance itself, that is equal to "x". The relative movement between the parts has the only function of moving the propeller in a more suitable position for generating the hoisting of the ground caused by the spirals and does not increase the drilling depth.

Furthermore, the document US2008/2170037 describes a machine provided with a telescopic tube which comprises at least two extended coaxial elements and reciprocally extractable. The tube extracts proportionally to the movement of the carriage which supports it and slides on the antenna.

It is to be noted that there is not a passage of pressurized fluid through the elements of the tube.

The present invention proposes a machine for drilling of the ground provided with a telescopic tube able to substantially increase its length (for example by doubling it at a value equal to approx. 2 times "x"), without losing the abovementioned characteristics of torque transmission, traction/thrust and above all the conservation of the pressure of the fluid which flows inside them.

SUMMARY

An aspect of the present invention refers to a drilling machine.

BRIEF DESCRIPTION OF THE DRAWINGS

The characteristics and the advantages of the present invention will be clearer and evident from the following description, exemplificative and not limitative, of an embodiment with reference to the attached figures wherein.

DETAILED DESCRIPTION

Figure 1:
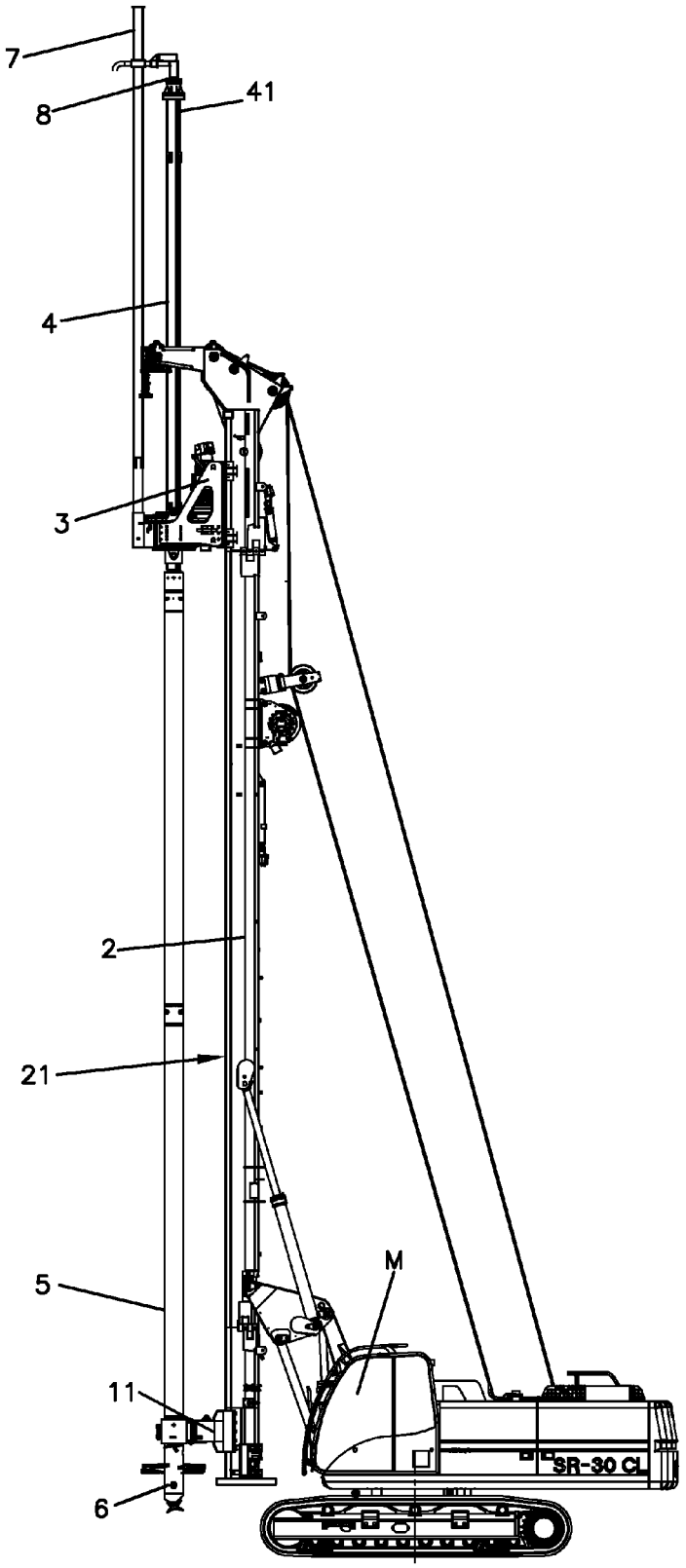
FIG. 1 shows a drilling machine provided with the tube according to the present invention.
Figure 2A:
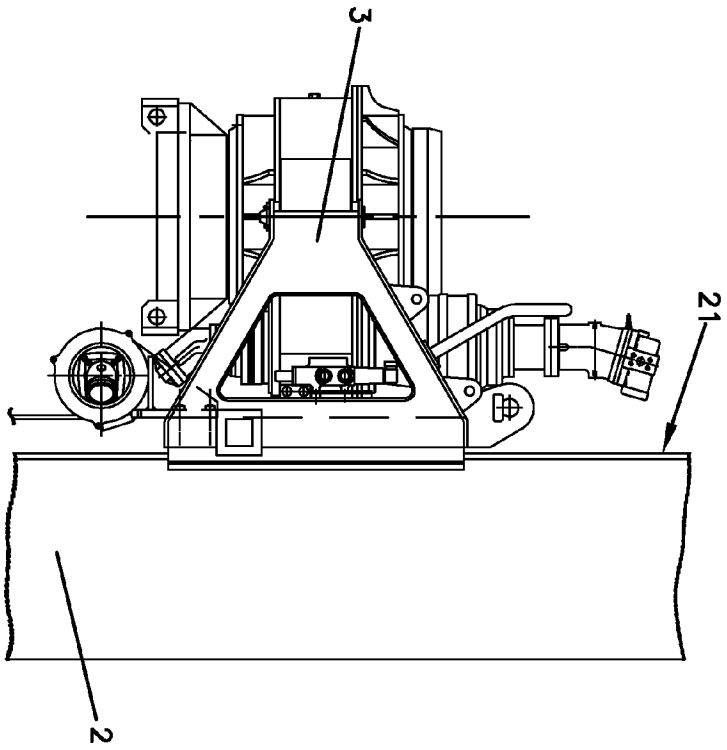
FIGS. 2*a* and 2*b* show a detail of the group for the moving of the drilling rods of the drilling machine.
Figure 2B:
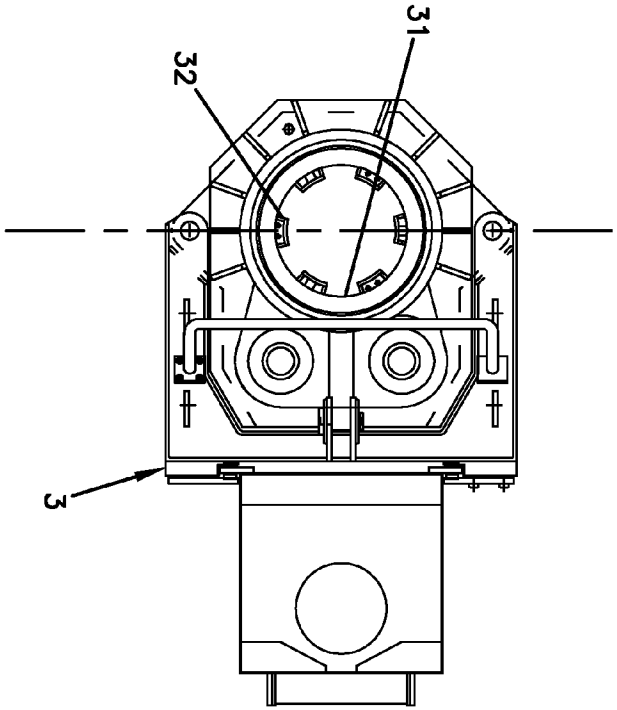
Figures 3A, 3B:
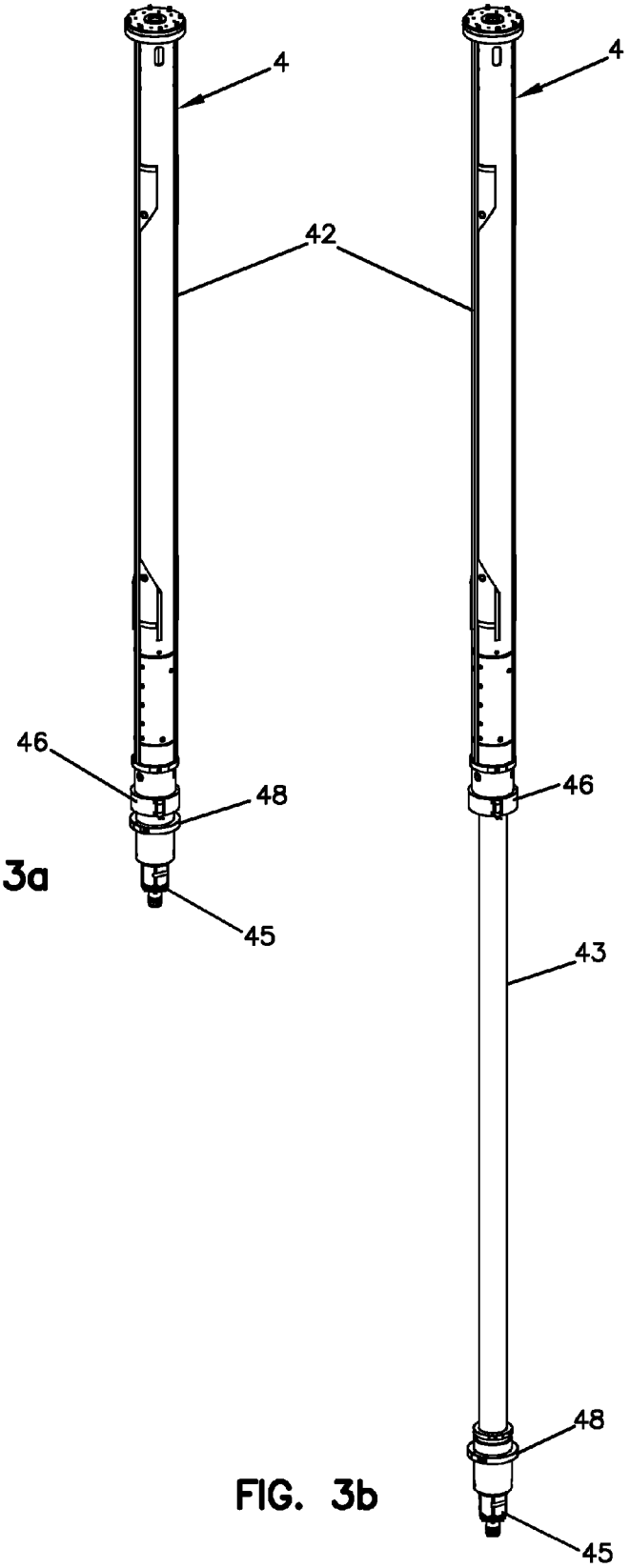
FIGS. 3*a* and 3*b* show the telescopic tube respectively in closed condition and open and extracted condition.
Figure 4A:
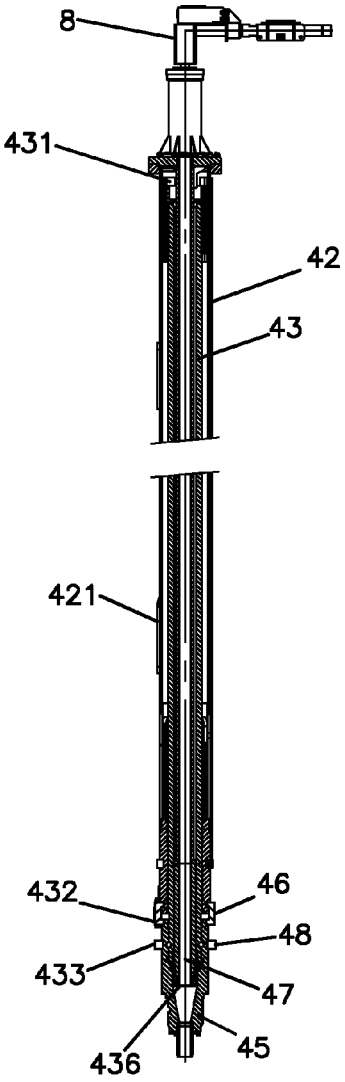
FIG. 4*a* shows the tube of FIG. 3*a* in longitudinal section.
Figure 4B:
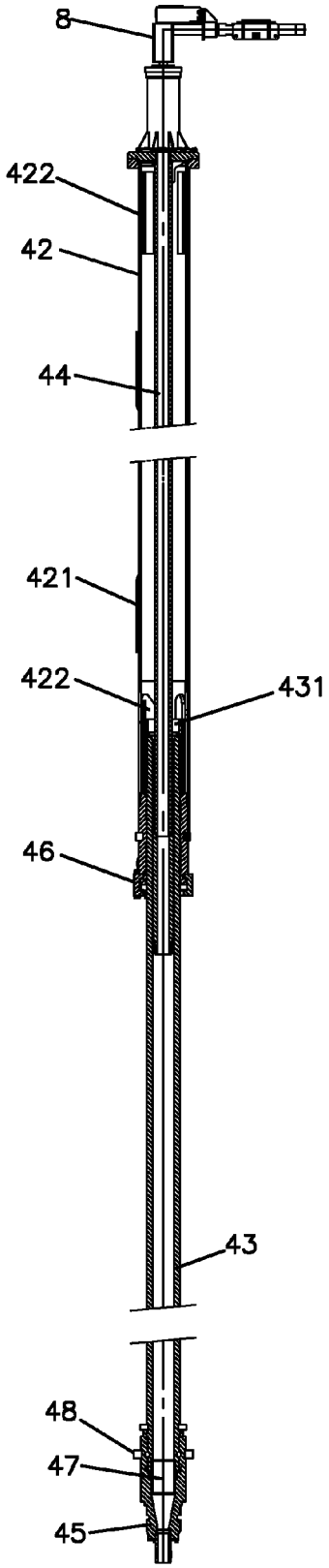
FIG. 4*b* shows the tube of FIG. 3*b* in longitudinal section.
Figure 5:
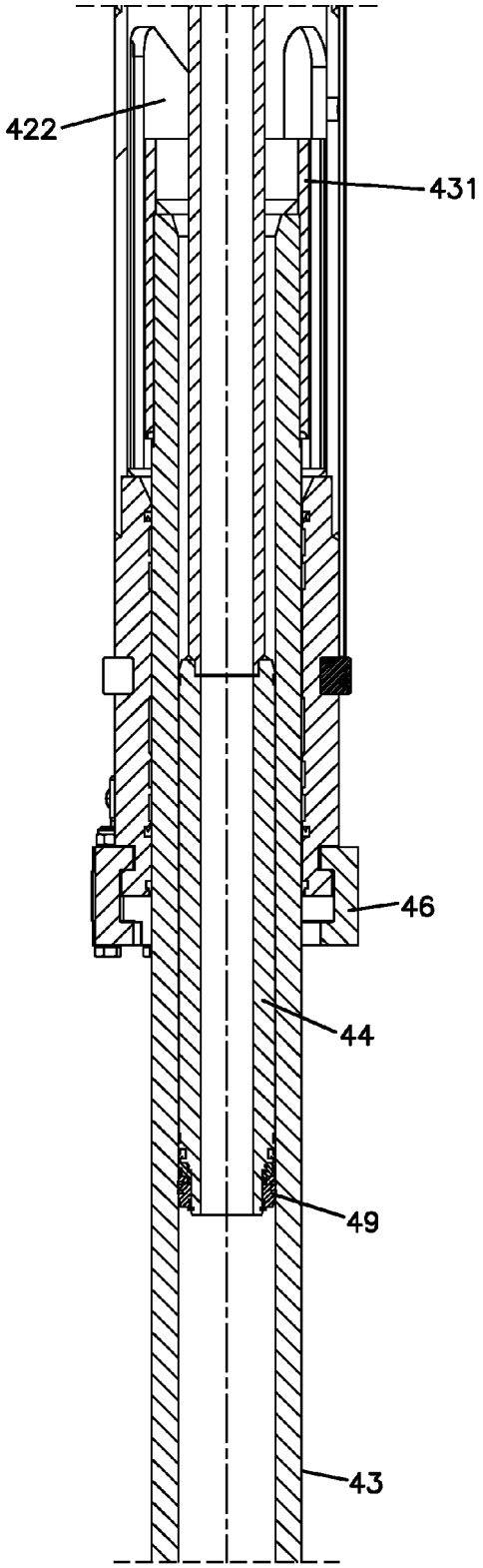
FIG. 5 shows a particular sectioned from the zone of the pressure seals among the rods of the tube in extracted condition.
Figure 6A:
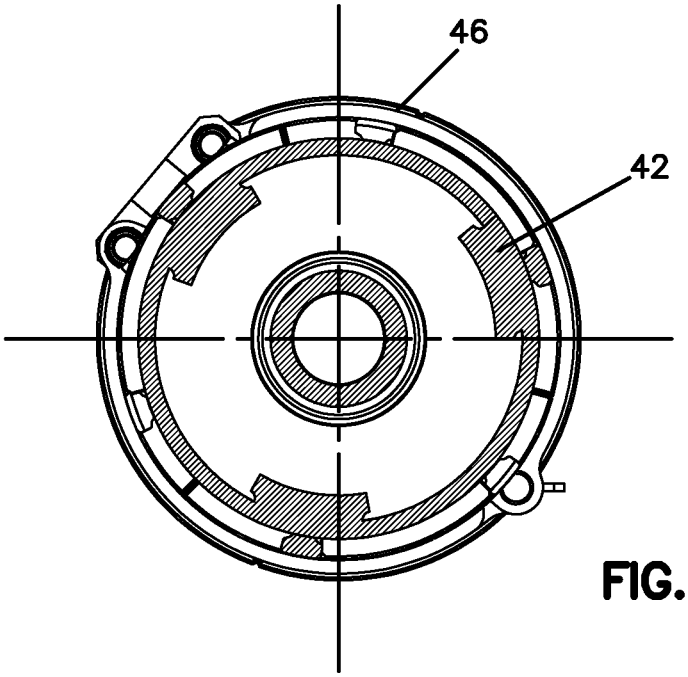
FIGS. 6*a* and 6*b* show respective radial sections in the insertion zone with respectively tube closed and tube open.
Figure 6B:
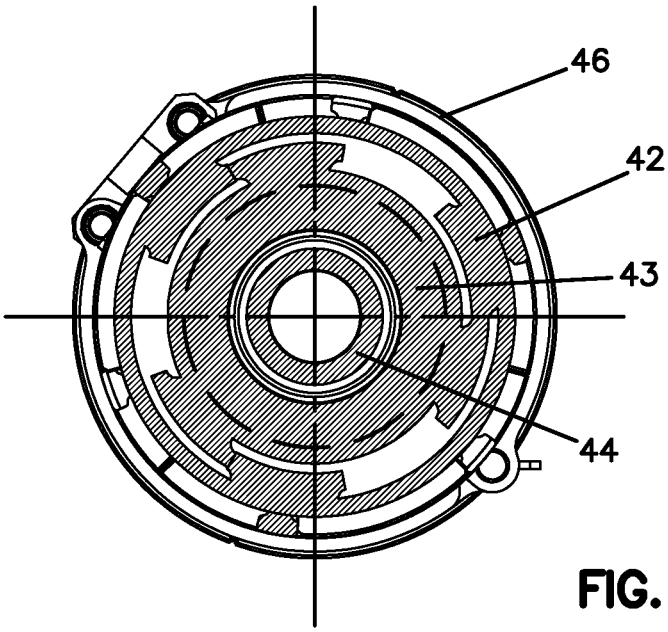
Figure 7:
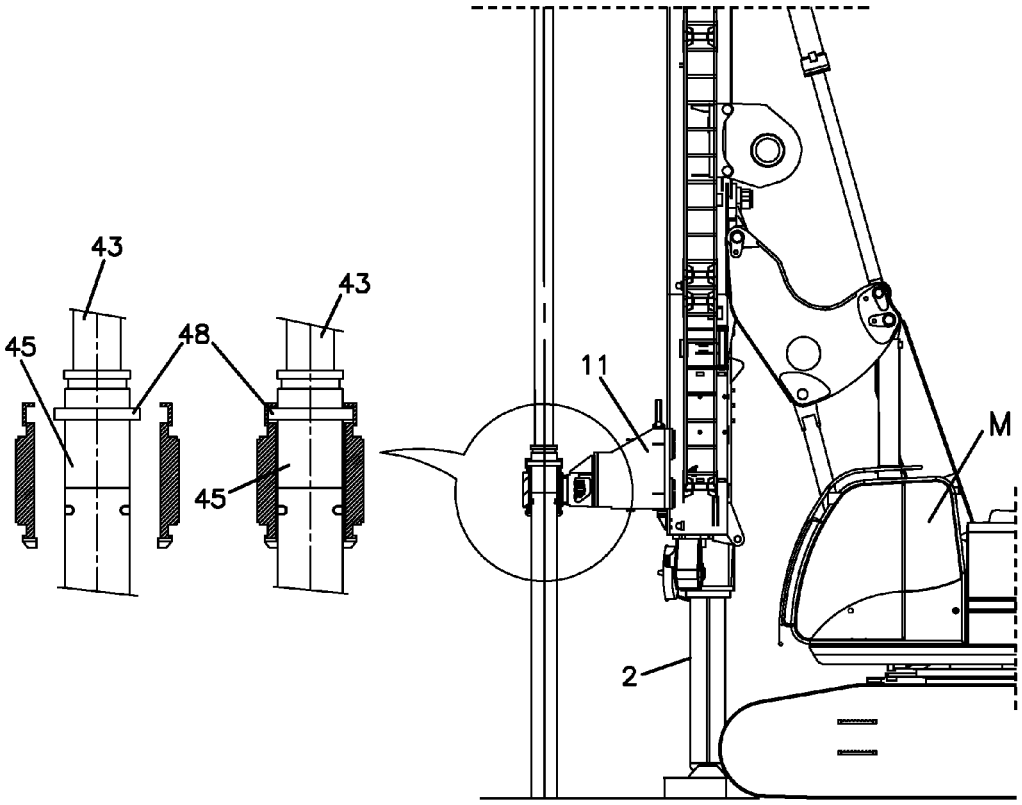
FIG. 7 shows the constraining zone between the group for the handling of the drilling rods and the telescopic tube.

With reference to the figures, telescopic tube 4 according to the present invention comprises an external extended element 42, intermediate extended element 43 and an inner extended element 44, all of them having approximately the same length and being coaxial.

Furthermore, the inner element and the external element are fixed with respect to one another and the intermediate element is extractable with respect to the other two.

On the tube there are also a rod adapter 45, arranged on the lower end of the tube and associated to the extractable intermediate extended element, a locking collar 46, a sleeve (preferably chromium plated) 47, and at least a support/joint collar 48 substantially provided at the lower end of the intermediate extended element.

External element 42 is provided with external listels 421 for torque transmission along substantially all of its length which associate to inner vertical listels 32 of the group of rod handling (rotary table).

Furthermore, in its inner part the external element has other listels 422, which transmit the same torque to the intermediate element when respectively intermediate element is completely closed, or completely open when it is extracted. External element 42 supports in its lower part locking collar 46 configured for example with a manual opening, which safely and definitively constrains the elements when the extraction of the tube is not required.

In the shown embodiment, inner element 44 ensures the conveying of the consolidating pressurized fluid from feeding head 8 flanged in its upper part of the tube, up to a channel located inside intermediate element 43.

Inner element 44 is not stressed with twisting torque and brings in its lower external part a waterproof sealing pack 49.

Intermediate element 43 receives the torque from external element 42 by radial listels positioned in its upper part 431. These listels insert in corresponding inner listels 422 of external element 42, when the tube is respectively completely closed and completely open or extracted.

Intermediate element 43 is not provided with any seal and is configured as an externally and internally turned tube, having in its external upper part the transmission listels of torque and thrust 431 and in its lower part a male hexagonal coupling 432, with seats for fixing pins 433 which ensures the interface, through adapter 45, with the first of drilling rods 5. The adapter can be advantageously replaced according to the rod typology adopted.

Intermediate element 43 shows advantageously on all of its surfaces a surface hardening and anti-oxidation treatment for preserving for the longest possible time the seals mounted in the grooves of the elements and against which, internally and externally, the extractable telescopic element slides.

Intermediate element 43 is therefore the extractor of the telescopic tube and is controlled by lifting or lowering the external and inner elements (engaged together) through for example a ropes traction, fixed directly on the external element or indirectly on the rotary table within which the external element is inserted.

For helping these movements, on the tube there are suitable venting devices. On external element 42 there are for example openings on the top for evacuating the fluid contained into the room closed between this element and intermediate element 43 during the closing or for inserting the element in case of opening.

Temporary openings are also provided on some elements for permitting direct access for the washing of the parts or for cleaning Sleeve 47 is fixed to the lower opening of intermediate element 43 and has a double function.

First, it is a wear element, easily replaceable, because the waterproof seals of the cement grout, work on its inner diameter, when the telescopic tube is completely closed. Furthermore, by dismounting the sleeve from the intermediate element, it is possible to access almost all of the waterproof seals, without having to extract the three elements which compose the telescopic tube, one element with respect to the other.

For further helping the replacement of the seals, in particular the seal in the ending part of inner element 44, the seal packs are mounted not directly on the inner element but on the watertight rings axially mounted on the inner element and here kept in correct position through a retainer 436.

An openable guide 11, preferably controlled hydraulically, arranged in fixed or slidable position in the lower part of tower 2 near the ground, has the task of retaining the rod battery to which the intermediate element is constrained, in the extraction and/or closing maneuvers of the telescopic element of the tube. Support/joint collar 48, mounted in its suitable seat present on adapter 45 and which finds an adequate checking element on the guide 11 helps the task of axially locking the telescopic tube while the other elements slide relatively in it, rising (opening) or descending (closing).

A secondary embodiment has a telescopic tube with two extended elements, extractable relatively the one with respect to the other. In this embodiment, external extended element 42 and intermediate one 43 are positioned identically, whereas inner element 44 is not present. According to this embodiment, when the telescopic tube is extracted, the consolidating fluid deriving from feeding head 8 contacts the inner part of external element 42 filling completely all the inner room. Therefore, the fluid is in direct contact with listels 422 and 431 during the movement and working phases and this can result into fast wear of the parts in contact or the relative seizure. For these reasons the primary form of embodiment is more advantageous because it insulates in a clean environment the parts designed for the transmission of the movement. However, the preferred solution is more complex because it requires inserting a third extended element provided with seals and fixed to external element 42 already present.

Some working typologies require operating in a lowered environment, for example for positioning consolidations under existing structures and buildings, under bridges or viaducts. In this case, the limited height implies a reachable maximum level which is relatively little (typical heights of 5-8 m). The drillings, and in particular the consolidation treatments, in this case are discontinuous because the rod battery is not always sufficient for covering the drilling depth required. Therefore, rod batteries are added and removed for obtaining the required depths.

The telescopic tube can be advantageously used for preventing the handling of drilling rods and could be mounted on all the extension of the tower and be connected directly to the drilling tool through an appropriate joint (typically as the adapter 45 already described).

In this case the drilling could reach depths approximately doubled with respect to the height available without requiring the handling of the rods.

The invention claimed is:

1. A machine for the drilling of the ground comprising:

a guide tower along which slides a maneuvering group for maneuvering of a battery of drilling rods, said maneuvering group moves along guides of the tower, the guides including an openable guide arranged in fixed or slidable position in a lower part of the guide tower;

said maneuvering group comprising a sleeve with inner vertical listels that conveys rotation to a tube;

a lower part of said tube being engageable to at least one of the drilling rods having a digging tool or is directly engageable to a digging tool;

said tube being a telescopic tube and comprises:

an external extended element, an intermediate extended element and an inner extended element, said intermediate element and said inner element being coaxial with the external extended element;

said inner element being fixed with respect to the external extended element and the intermediate element being extractable with respect to the other two elements;

said external element of the tube being provided with external torque transmission listels all substantially an entire length of the external element, the external torque transmission listels correspond with the inner vertical listels of the sleeve of the maneuvering group;

said tube extends at least partially over the sleeve of the maneuvering group;

said tube working with an inner fluid under pressure flowing inside at least one of the extended elements; and an openable guide retaining the rod battery to which the intermediate element is constrained, in extracting maneuvers and/or closing maneuvers of the telescopic tube.

2. The machine according to claim 1, wherein the inner fluid under pressure is a consolidating fluid.

3. The machine according to claim 1, further comprising a rod adapter, arranged on the lower part of the tube and associated to the intermediate extended element.

4. The machine according to claim 1, wherein at least a locking collar is present on the tube.

5. The machine according to claim 1, wherein at least a support/joint collar is present on the tube substantially provided on the lower part of the intermediate extended element.

6. The machine according to claim 1, wherein the intermediate element is controlled by lifting or lowering the external and inner elements applying a traction force by a rope, fixed directly to the external element or indirectly acting on the maneuvering group within which the external element is fixed.

7. The machine according to claim 1, wherein all extended surfaces of the intermediate element have a protection treatment against oxidation and erosion.

8. The machine according to claim 1, wherein said openable guide is not manually controlled.

9. The machine according to claim 1, wherein said openable guide is hydraulically controlled.

10. The machine according to claim 1, wherein the support/joint collar, mounted in suitable seat present on the adapter, finds a match with said guide axially locking telescopic movement of the tube.

* * * * *